US006296346B1

(12) United States Patent
Seo et al.

(10) Patent No.: US 6,296,346 B1
(45) Date of Patent: Oct. 2, 2001

(54) APPARATUS FOR JETTING INK UTILIZING LAMB WAVE AND METHOD FOR MANUFACTURING THE SAME

(75) Inventors: O-Gweon Seo, Yongin; Seung-Ho Nam, Sungnam; Byoung-Lyong Choi, Seoul; Young-Jin Song, Yongin, all of (KR)

(73) Assignee: Samsung Electronic Co., Ltd., Kyungki-Do (KR)

( * ) Notice: Subject to any disclaimer, the term of this patent is extended or adjusted under 35 U.S.C. 154(b) by 0 days.

(21) Appl. No.: 09/285,238

(22) Filed: Apr. 2, 1999

(30) Foreign Application Priority Data

Jun. 12, 1998 (KR) ..... 98-21838

(51) Int. Cl.[7] ..... B41J 2/04
(52) U.S. Cl. ..... 347/54
(58) Field of Search ..... 347/68, 69, 70, 347/71, 72, 50, 40, 27, 46, 54; 399/261; 361/700; 310/320–334, 338; 216/48, 4; 430/311

(56) References Cited

U.S. PATENT DOCUMENTS 5,953,027 9/1999 Suwade et al. .
5,988,799 * 11/1999 Abe et al. .

FOREIGN PATENT DOCUMENTS 0 387 863 A2 9/1990 (EP) .
0 430 087 B1 * 2/1995 (EP) .
0 728 584 A2 8/1996 (EP) .
54010731 A 1/1979 (JP) ..... B41J/3/40
0 430 087 B1 2/1995 (JP) .
10109422 A 4/1998 (JP) ..... B41J/2/06

OTHER PUBLICATIONS

Japanese Abstract No. 09–183225, dated Jul. 15, 1997.
Japanese Abstract No. 06–050870, dated Feb. 25, 1994.

* cited by examiner

*Primary Examiner*—Raquel Yvette Gordon
(74) *Attorney, Agent, or Firm*—Sughrue, Mion, Zinn, Macpeak & Seas, PLLC

(57) ABSTRACT

An apparatus for jetting ink utilizing a lamb wave and a method for producing the same, the apparatus including an ink chamber having nozzles, and an ejecting force source for supplying an ejecting force to eject the ink out of the nozzles. The ejecting force source includes inter-digital transducer electrodes for applying a voltage of a predetermined voltage, a piezoelectric element for generating the lamb wave by means of the voltage applied from the inter-digital transducer electrodes. Thus, as the voltage is applied to the inter-digital transducer electrodes, the lamb wave is generated from the lamb wave generating board, and the ink reserved in the ink chamber is ejected out of the nozzles.

15 Claims, 7 Drawing Sheets

APPARATUS FOR JETTING INK UTILIZING LAMB WAVE AND METHOD FOR MANUFACTURING THE SAME

BACKGROUND OF THE INVENTION

1. Field of the Invention

The present invention relates to an apparatus for jetting ink of an ink-jet print head, and more particularly, to an apparatus for jetting ink by utilizing lamb wave and manufacturing the same.

2. Description of the Prior Art

An apparatus for jetting ink applied to a conventional ink-jet print head ejects a desired amount of the ink through a nozzle by exerting a physical force to the ink received in an ink chamber. Generally, such apparatuses are grouped by the type of system used to eject the ink, for example a piezoelectric system, a thermal system, and an electromagnetic system, etc.

Companies such as Canon and Hewlett-Packard Co. are well known for providing thermal print heads. As shown in FIG. 1, the thermal print head includes a lower insulating layer 14, a heating element 16, electrodes 18, an upper insulating layer 20, and a protecting layer 22 which are sequentially stacked on a printed circuit board (PCB) 12. Passage walls 23 are installed between a nozzle plate 24 and the protecting layer 22 to form an ink chamber 26. The ink chamber 26 is connected to a reservoir (not shown), and both electrodes 18 are connected to a driving signal generator 28.

When the driving signal generator 28 applies a driving signal to the electrodes 18, the heating element 16 is heated, and ink 27 within the ink chamber 26 is boiled. At this time, bubbles 29 are produced within the ink chamber 26, and the bubbles 29 push the ink 27 out of a nozzle 25 of the nozzle plate 24, thereby producing an ink jet 30.

Companies such as Epson are well known for providing piezoelectric print heads. As shown in FIG. 2, a piezoelectric print head includes a PCB 42, a diaphragm 44, a piezoelectric element 46, a spacer 48 and a nozzle plate 50. An ink chamber 54 is formed by the diaphragm 44, the piezoelectric element 46 and the nozzle plate 50. The interior of the ink chamber 54 is filled with ink 53. When the driving signal generator 52 applies a driving signal to the piezoelectric element, the piezoelectric element 46 mechanically expands and contracts. The expanding and contracting action of the piezoelectric element 46 causes the ink within the ink chamber 54 to be ejected from the nozzle 51, thereby producing an ink jet 55.

An electro-magnetic print head includes a magnet driver attached to an outer side of a nozzle, and a magnetically active diaphragm plate for sealing an ink chamber. The ink is ejected by a pressure which is exerted when the magnetically active diaphragm plate is deformed by a magnetic field generated by the magnet driver.

Although conventional print heads are generally thought to be acceptable, they are not without shortcomings. Specifically, piezoelectric print heads are expensive and have a complex structure. Thermal print heads are slow because of the time required to heat the ink, and the heating process deteriorates the ink. Further, the thermal print head has a complex structure making production difficult thus deteriorating the productivity. Finally, an electro-magnetic print head has a lower print quality than the other types of print heads because an induction current causes ink to be inadvertently ejected out of nozzles which are adjacent to the nozzles through which ink is intended to be ejected from.

SUMMARY OF THE INVENTION

An object of the present invention is to provide an apparatus for jetting ink having a simple structure for easier manufacture, high quality print-out, and long durability.

Another object of the present invention is to provide an apparatus for jetting ink having a simple structure produced by simple processes so as to decrease a manufacturing cost.

In order to accomplish these objects, the apparatus for jetting ink of present invention includes an ink chamber having nozzles, an ejecting force source for supplying an ejecting force so as to eject the ink within the ink chamber through the nozzles, wherein the ejecting force is a lamb wave.

The ejecting force source includes electrodes for applying a predetermined voltage, and a lamb wave generating board for generating the lamb wave by means of the voltage applied from the electrodes. The electrodes are inter-digital transducers (IDT) disposed along the upper surface of the lamb wave generating board. Preferably, the electrodes are arranged such that the same produce reinforcement interferences of lamb waves at the predetermined positions of the lamb wave generating board. Here, the predetermined positions of lamb wave generating board are aligned with the nozzles. The lamb wave generating board is a piezoelectric element, and preferably, has a C-axis orientation of high piezoelectric efficiency.

Preferably, a transfer board is disposed between the lamb wave generating board and the ink chamber. The transfer board is a material that has a larger modulus of elasticity and a larger fatigue limit, such as ceramic, metal, and the like. More preferably, a grounded electrode is disposed between the lamb wave generating board and the ink chamber in order to enhance the lamb wave generating efficiency.

Another object of the present invention is accomplished by a method for producing the apparatus for jetting ink according to the present invention including a step of forming the transfer board on the silicon board, a step of forming the grounded electrode on the transfer board, a step of forming a pattern of electrodes on the lamb wave generating board, a step of forming a chamber on a side of the silicon board that faces away from the transfer board, and a step of forming nozzles in the ink chamber. The ink chamber may be formed by lithographic, and a wet etching processes.

Thus, as the voltage is applied to the IDT electrodes, the lamb wave is generated from the lamb wave generating board, and the ink within the chamber is ejected out of the nozzles by the lamb wave. Accordingly, the apparatus for jetting ink has a simple structure, enhanced durability, and the ink reserved in the apparatus does not deteriorate.

The above and other features of the invention including various and novel details of construction and combination of parts will now be more particularly described with reference to the accompanying drawings and pointed out in the claims. It will be understood that the particular apparatus for ejecting ink embodying the invention is shown by way of illustration only and not as a limitation of the invention. The principles and features of this invention may be employed in varied and numerous embodiments without departing from the scope of the invention.

DETAILED DESCRIPTION OF THE PREFERRED EMBODIMENT

Figure 1:
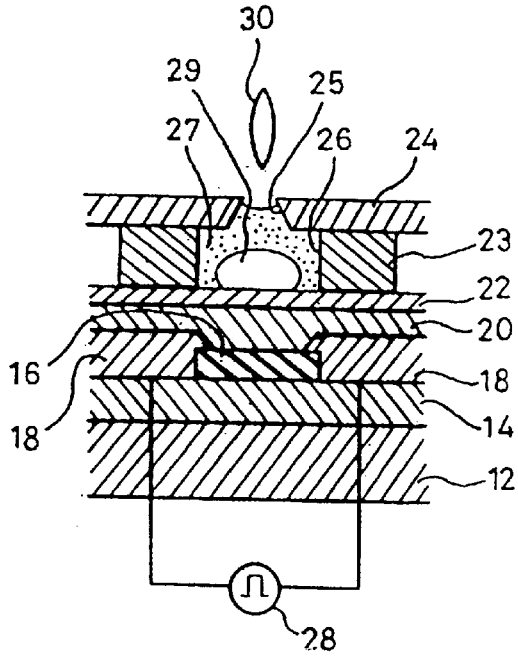
FIG 1 (PRIOR ART)
FIG. 1 is a partial, sectional view of a conventional, thermal print head.
Figure 2:
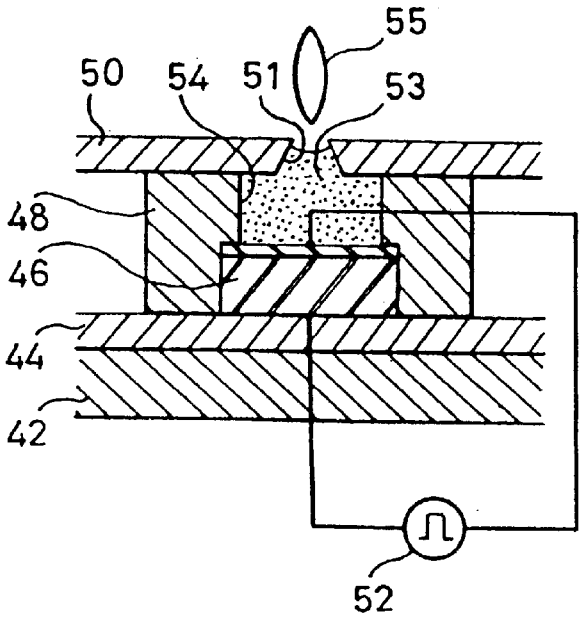
FIG 2 (PRIOR ART)
FIG. 2 is a partial, sectional view of a conventional, piezoelectric print head.
Figure 3:
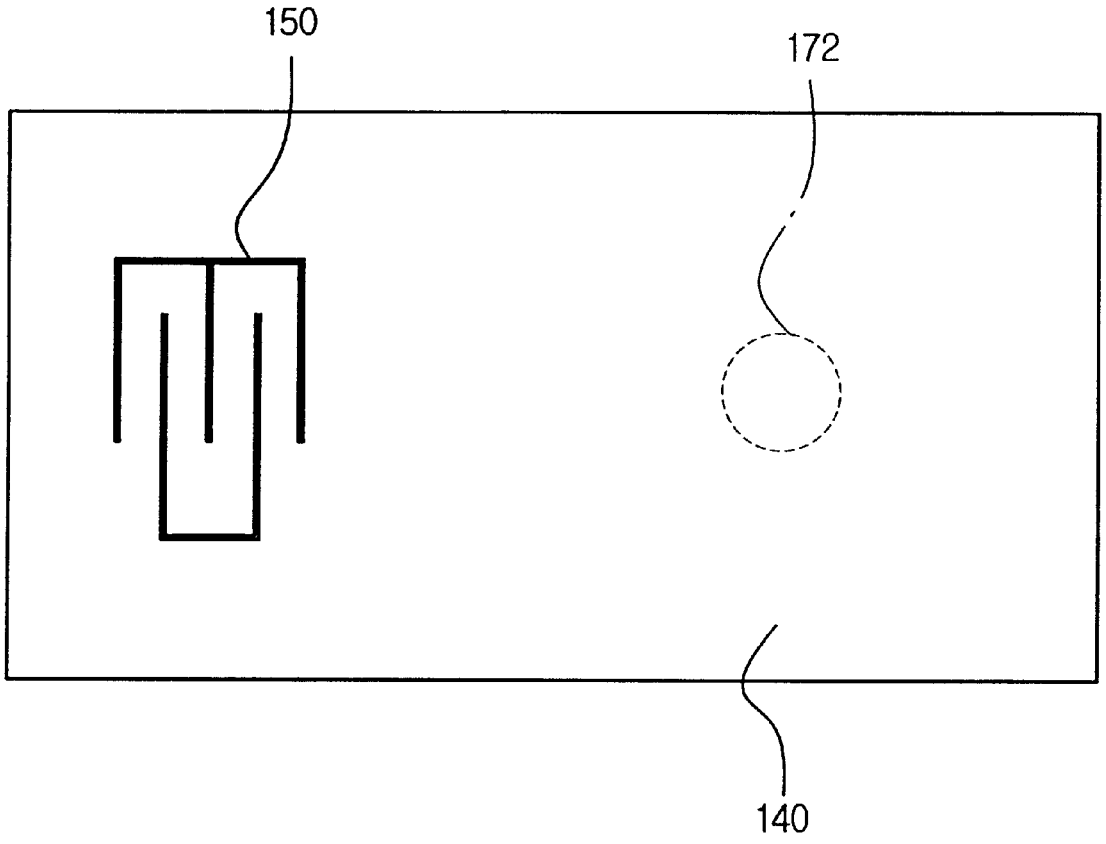
FIG. 3 is a plan view of an apparatus for jetting ink according to the present invention.
Figure 4:
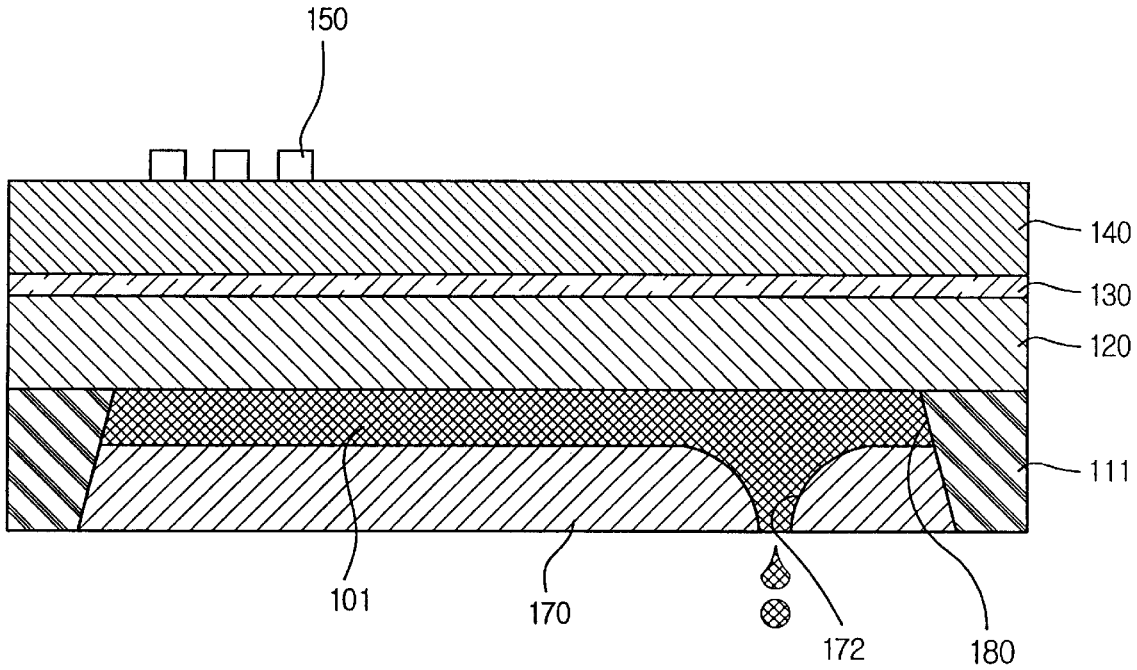
FIG. 4 is a sectional view of an apparatus for jetting ink according to the present invention.

With reference to FIGS. 3 and 4, an apparatus for jetting ink according to the present invention is formed such that a nozzle plate 170, a barrier 111, a transfer board 120, a grounded electrode 130, a lamb wave generating board 140, and IDT electrodes 150 are sequentially stacked on one another.

An ink chamber 180 for receiving the ink is defined by the nozzle plate 170, the barrier 111, and the transfer board 120. The nozzle plate 170 has nozzles 172 through which the ink received in the ink chamber 180 is ejected.

As the voltage is applied to the IDT electrodes 150, the lamb wave is generated by the lamb wave generating board 140. The lamb wave generating board 140 is formed of a piezoelectric element, such as ZnO, PZT (Lead (Pb) Zirconate Titanate), AIN (Aluminum Nitride), etc. Additionally, the grounded electrode 130 is disposed in order to enhance the lamb wave generating efficiency. The transfer board 120 is disposed between the lamb wave generating board 140 and the ink chamber 180 for manufacturing convenience. As for the transfer board 120, a material having the larger modulus of elasticity and the larger fatigue limit can be utilized. Preferably, the transfer board is fabricated from a metal or a silicon material, such as Si3N4. Thus, the lamb wave generating board 140, the transfer board 120, the grounded electrode 130, and the IDT electrodes 150 generate the lamb wave so as to supply the ejecting force to the ink received in the ink chamber 180.

Figure 5:
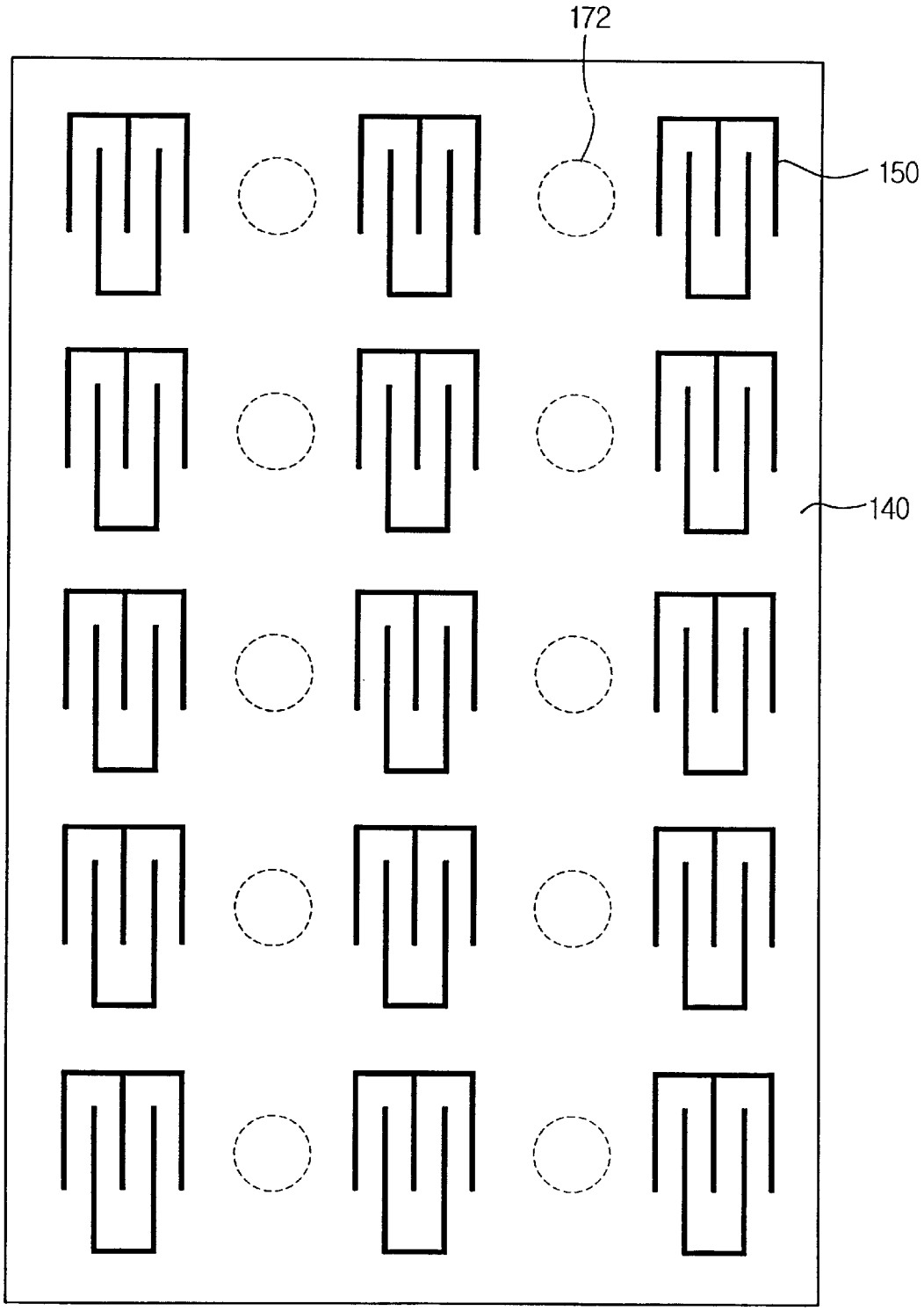
FIG. 5 is a plan view of an apparatus for jetting ink according to the present invention employed in a head of a printer.
Figure 6:
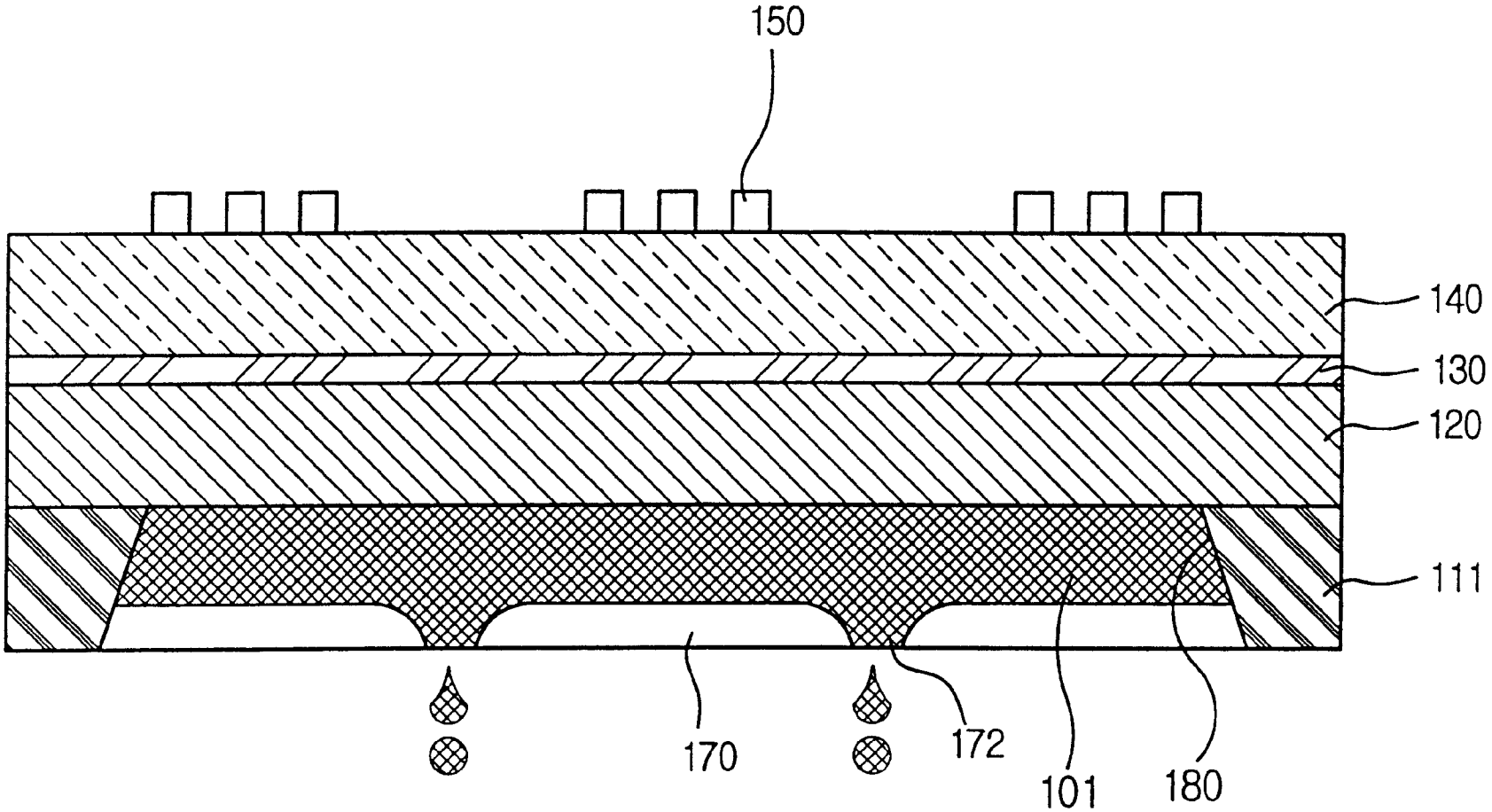
FIG. 6 is a sectional view of an apparatus for jetting ink according to the present invention employed in a head of a printer.

FIGS. 5 and 6 show the head of an ink-jet printer incorporating a plurality of apparatuses for jetting ink according to the present invention. As shown in FIG. 5, the nozzles 172 and the IDT electrodes are linearly arranged, such that a line of IDT electrodes 150 is provided on both sides of a line of nozzles 172. The IDT electrodes 150 are arranged such that the lamb waves generated therefrom make reinforcement inference at the positions aligned with the nozzles 172.

The manufacture method of such apparatus for jetting ink will be described in greater detail with reference to FIGS. 7A and 7B.

Figure 7A:
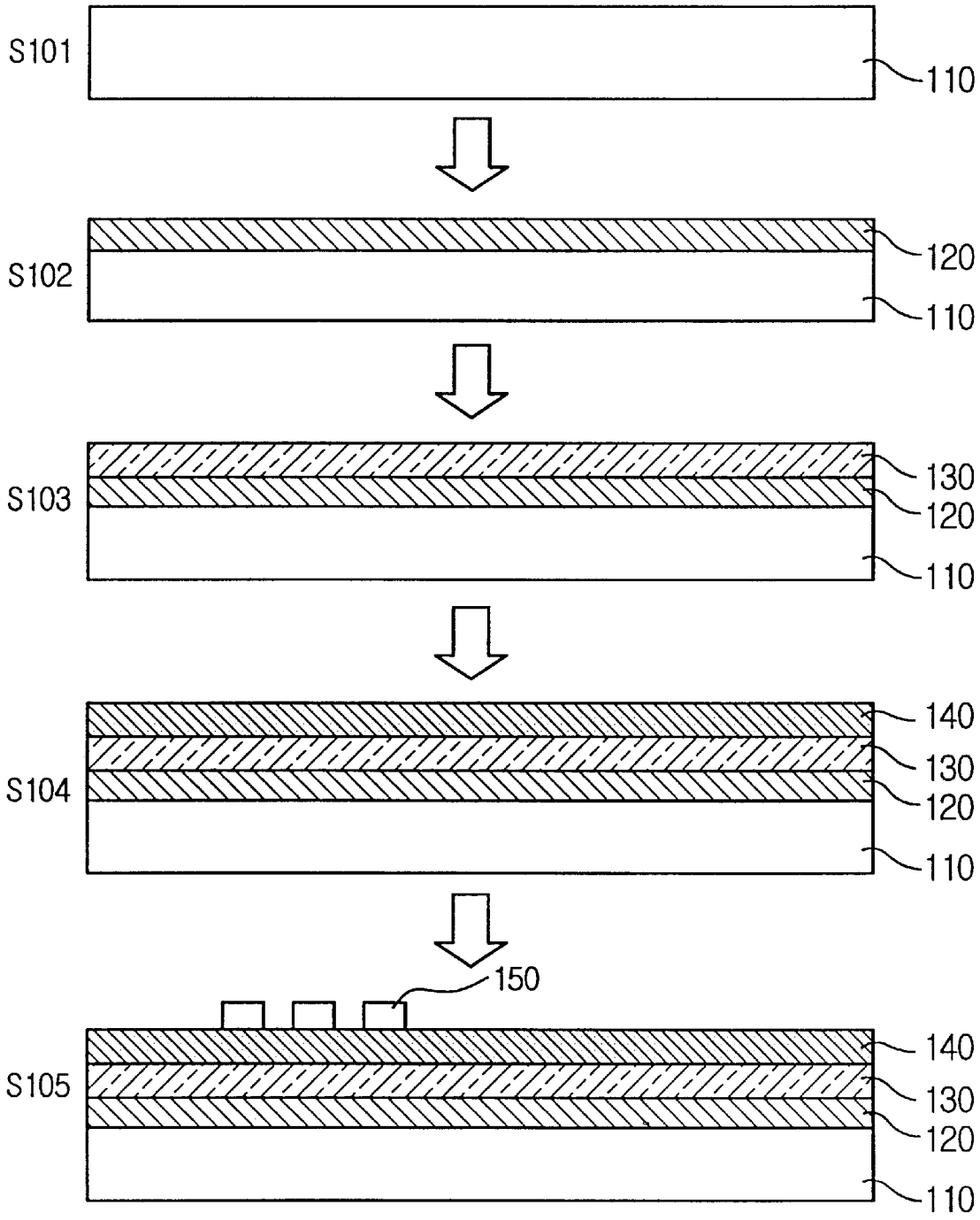
FIGS. 7A and 7B are views for explaining a method for producing an apparatus for jetting ink according to the present invention.
Figure 7B:
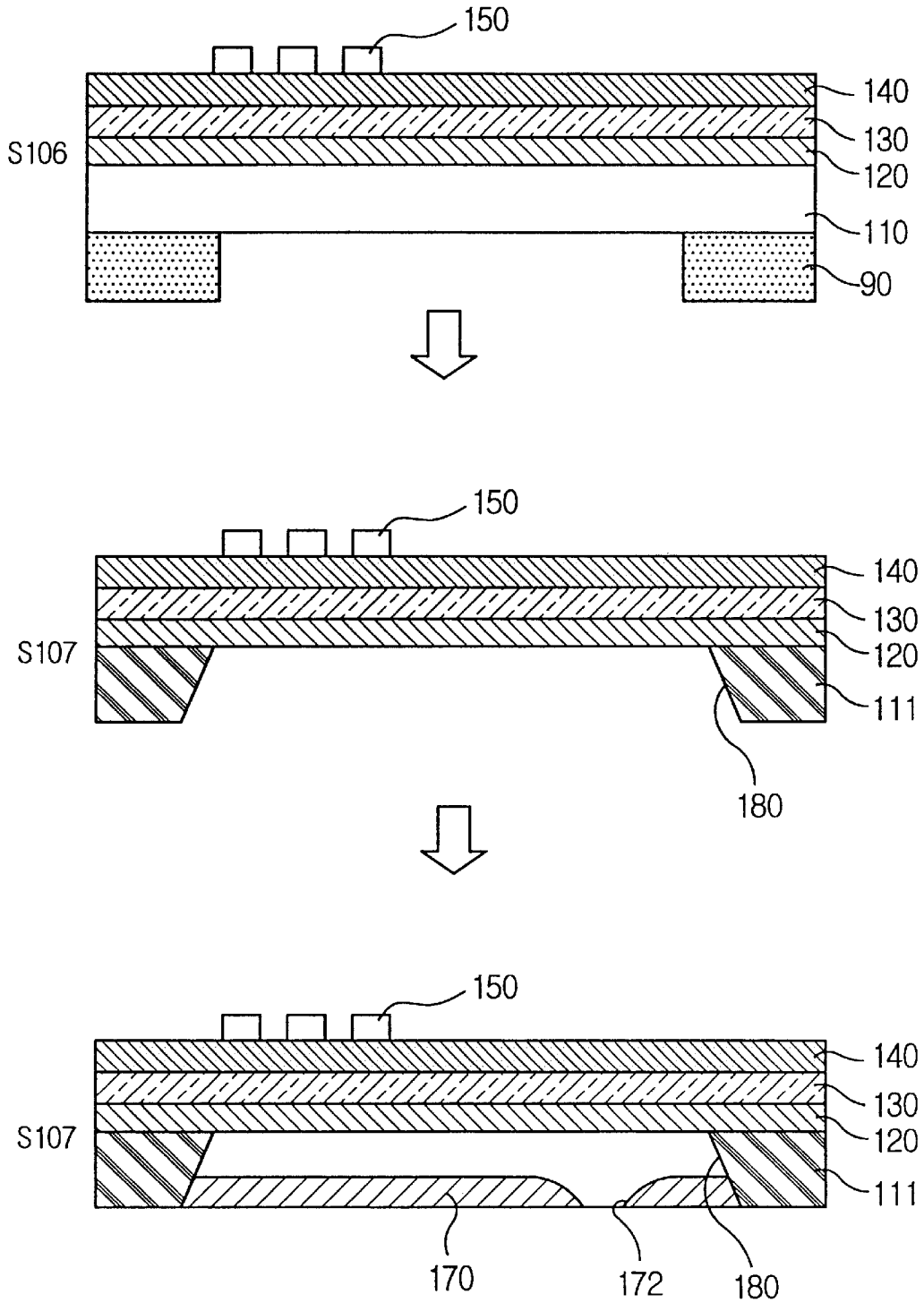

As shown in FIGS. 7A and 7B, the silicon board 110 is prepared (S101). Next, the transfer board 120 is coated over the silicon board 110 (S102). The transfer board 120 is approximately 0.5–10 $\mu$m thick. Then, the grounded electrode 130 is formed on the upper surface of the transfer board 120 (S103). The grounded electrode 130 is formed from a metal such as Pt, Al, Ta, etc.

The lamb wave generating board 140 is coated over the grounded electrode 130 (S104). In this step, a conventional magnetron sputtering, SOL-GEL, or CVD may be applied. Preferably, the lamb wave generating board 140 is coated to have a C-axis orientation for higher piezoelectric efficiency.

Then, the IDT electrodes 150 are disposed on the upper surface of the lamb wave generating board 140 (S105). First, an IDT electrode board is coated over the upper surface of the lamb wave generating board 140. Then, the IDT electrodes 150 are patterned as shown in FIG. 5 by a lithographic process. A positive point and a negative point of each IDT electrode 150 confront each other. Preferably, the width of interval between the IDT electrodes 150 ranges from several $\mu$m to several hundred $\mu$m so as to make the wave length of the lamb waves range from several ten to several hundred times as great as the thickness of the lamb wave generating board 140, the grounded electrode 130, and the transfer board 120.

Then, the ink chamber 180 is formed at the silicon board 110 (S106–S107). More specifically, a sensitive material pattern 90 is formed at the lower surface of the silicon board 110 by a lithographic process (S106), and then wet etched (S107). Consequently, the ink chamber 180, and the barrier 111 serving as side walls of the ink chamber 180 are formed. Last, the nozzle plate 170 having a plurality of nozzles 172 is formed at the lower side of the ink chamber 180 (S108).

The operation of an apparatus for jetting ink according to the present invention is described below.

A bias voltage of several tens of volts V to several hundreds of volt V is applied to the IDT electrodes 150 as a driving signal. As the bias voltage is applied to the IDT electrodes 150, the lamb wave is generated by the lamb wave generating board 140 formed beneath the IDT electrodes 150. The lamb wave, a kind of surface acoustic wave, propagates along the surface of the lamb wave generating board 140 with a speed of several hundred meters per second. When the lamb wave reaches the ink 101 reserved within the ink chamber 180 via the transfer board 120, a force having an orientation perpendicular with respect to the propagation direction of the lamb wave is applied to the ink 101. Accordingly, the ink 101 within the ink chamber 180 ebbs and flows in wide vertical waves and reaches the positions aligned with the nozzles 172 so as to be ejected out of the nozzles 172. If the nozzles 172 and IDT electrodes 150 are arranged as shown in FIG. 5, the lamb waves generated from the IDT electrodes 150 make reinforcement inferences at the positions aligned with the nozzles 172. Consequently, the ejecting force applied to the ink 101 within the ink chamber 180 is amplified, so that the ejecting efficiency of the ink 101 is enhanced.

As described, the apparatus for jetting ink utilizing the lamb wave of the present invention has a simple structure so that it is produced with convenience with a relatively low cost for raw materials. Further, since the ink ejection of the present invention does not require heat, the ink does not deteriorate. Yet further, the apparatus for jetting ink according to the present invention operates by means of relatively small mechanical movement, so that the durability thereof is enhanced.

While the present invention has been particularly shown and described with reference to the preferred embodiment thereof, it will be understood by those skilled in the art that various changes in form and details may be effected therein without departing from the spirit and scope of the invention as defined by the appended claims.

What is claimed is:

1. An apparatus for jetting ink comprising:

an ink chamber, for reserving an ink therein, provided with a nozzle; and means for supplying an ejecting force to the ink reserved within the ink chamber so as to eject the ink out of the nozzle;

wherein the ejecting force is a lamb wave.

2. The apparatus as claimed in claim 1, wherein the means for supplying the ejecting force comprises:

a lamb wave generating board provided adjacent to the ink chamber; and an electrode provided on the lamb wave generating board for applying a predetermined voltage to the lamb wave generating board, thereby causing a lamb wave to propagate along the lamb wave generating board.

3. The apparatus as claimed in claim 2, wherein the electrode is an inter-digital transducer electrode disposed on a surface of the lamb wave generating board facing away from the ink chamber.

4. The apparatus as claimed in claim 2, further including a plurality of electrodes provided on the lamb wave generating board, wherein the plurality of electrodes are arranged in a pattern, such that the lamb waves generated therefrom make reinforcement interferences.

5. The apparatus as claimed in claim 4, wherein the ink chamber is provided with a plurality of nozzles, and wherein the plurality of electrodes are arranged such that the reinforcement interferences occur at positions which are aligned with the plurality of nozzles.

6. The apparatus as claimed in claim 2, wherein the lamb wave generating board is a piezoelectric element.

7. The apparatus as claimed in claim 6, wherein the piezoelectric element has a C-axis orientation of high piezoelectric efficiency.

8. The apparatus as claimed in claim 2, further comprising:

a transfer board interposing between the lamb wave generating board and the ink chamber.

9. The apparatus as claimed in claim 8, wherein the transfer board has a larger modulus of elasticity of and a larger fatigue limit than the lamb wave generating board.

10. The apparatus as claimed in claim 9, wherein the transfer board is fabricated from a ceramic material.

11. The apparatus as claimed in claim 9, wherein the tansfer board is fabricated from a metal material.

12. The apparatus as claimed in claim 2, further comprising:

a grounded electrode, for enhancing a lamb wave generating efficiency, interposing between the lamb wave generating board and the ink chamber;

wherein the electrode, for applying the predetermined voltage, is provided on a side of the lamb wave generating board facing away from the ink chamber.

13. An apparatus for jetting ink comprising:

an ink chamber having nozzles;

inter-digital transducer electrodes for applying a predetermined voltage;

a piezoelectric board for generating a lamb wave by means of the predetermined voltage applied by the inter-digital transducer electrodes;

a transfer board disposed between the piezoelectric board and the ink chamber for transferring the lamb wave generated by the piezoelectric board to the ink chamber; and a grounded electrode disposed between the piezoelectric board and the transfer board for enhancing the lamb wave generating efficiency.

14. A method for producing an apparatus for jetting ink comprising the steps of:

providing a silicon board;

forming a transfer board on the silicon board;

forming a grounded electrode on the transfer board;

forming a lamb wave generating board on the grounded electrode;

forming a pattern of electrodes on the lamb wave generating board;

forming an ink chamber on a side of the silicon board facing away from the transfer board; and forming nozzles in the ink chamber.

15. The method as claimed in claim 14, wherein the step of forming the ink chamber is achieved by a lithographic process, and wet etching.

* * * * *